US007794309B2

(12) United States Patent
Wendt-Ginsberg et al.

(10) Patent No.: US 7,794,309 B2
(45) Date of Patent: Sep. 14, 2010

(54) POLISHING TOOL

(75) Inventors: Marion Wendt-Ginsberg, Windeck (DE); Frank Wendt, Windeck (DE)

(73) Assignee: Wendt Poliertechnik GmbH & Co. KG, Windeck (DE)

( * ) Notice: Subject to any disclaimer, the term of this patent is extended or adjusted under 35 U.S.C. 154(b) by 161 days.

(21) Appl. No.: 10/363,359

(22) PCT Filed: Aug. 28, 2001

(86) PCT No.: PCT/EP01/09903

§ 371 (c)(1),
(2), (4) Date: Oct. 3, 2003

(87) PCT Pub. No.: WO02/18102

PCT Pub. Date: Mar. 7, 2002

(65) Prior Publication Data

US 2004/0048560 A1 Mar. 11, 2004

(30) Foreign Application Priority Data

Aug. 28, 2000 (DE) ..... 100 42 109

(51) Int. Cl.
*B24B 9/02* (2006.01)

(52) U.S. Cl. ..... 451/466; 451/469

(58) Field of Classification Search ..... 451/177, 451/526, 527, 529, 532–535, 544, 464–469, 451/117

See application file for complete search history.

(56) References Cited

U.S. PATENT DOCUMENTS 1,417,593 A * 5/1922 Christine ..... 15/230.13
3,191,208 A 6/1965 Churchill
3,406,488 A 10/1968 Rykken
4,090,333 A * 5/1978 Block et al. ..... 451/468
4,183,183 A * 1/1980 Belanger ..... 451/469
4,275,529 A 6/1981 Teetzel et al.
4,302,911 A 12/1981 Leistner
4,625,466 A * 12/1986 Saigusa ..... 451/535
5,662,515 A * 9/1997 Evensen ..... 451/527
5,722,881 A * 3/1998 Emerson ..... 451/466
5,903,951 A * 5/1999 Ionta et al. ..... 451/466
5,964,650 A * 10/1999 Born et al. ..... 451/526
5,989,113 A * 11/1999 Arnold ..... 451/532
6,066,034 A * 5/2000 Hettes et al. ..... 451/466
6,312,485 B1 * 11/2001 Kaiser et al. ..... 451/527
6,506,100 B2 * 1/2003 Blattler ..... 451/535

(Continued)

FOREIGN PATENT DOCUMENTS

DE NR 1940005 6/1966

(Continued)

OTHER PUBLICATIONS

1998/1999 tool catalogue of the company Hch. Perschmann GmbH, Braunschweig, pp. 462 and 464.

(Continued)

*Primary Examiner*—Hadi Shakeri
(74) *Attorney, Agent, or Firm*—Baker & Daniels LLP

(57) ABSTRACT

The invention relates to a polishing tool with improved handling characteristics, which produces better working results. Said tool comprises a solid polishing body (1), substantially consisting of felt, said body having numerous subdivisions (1).

4 Claims, 9 Drawing Sheets

U.S. PATENT DOCUMENTS 6,866,572 B1 * 3/2005 Wendt-Ginsberg et al. .. 451/465

FOREIGN PATENT DOCUMENTS

| | | |
|---|---|---|
| DE | 25 01 589 | 7/1975 |
| DE | 19930373 A1 | 2/2000 |
| DE | 19843267 A1 | 3/2000 |
| GB | 2 150 470 A | 7/1985 |
| JP | 60094271 | 5/1985 |
| JP | 01-016376 | 1/1989 |

OTHER PUBLICATIONS

Catalogue Machinery and Tools for Surface Machining from the firm Suhner Abrasive Expert AG, Brugg, Switzerland, 1998 edition.

* cited by examiner

POLISHING TOOL

FIELD OF THE INVENTION

The invention concerns a polishing tool, particularly to be rotatably driven by a machine tool, or by a hand operated machine.

BACKGROUND OF THE INVENTION

Polishing is to be understood as a method for the chip-making fine-machining of surfaces employing a geometrically undefined cutting edge, the removal of stock being accomplished by means of a polishing agent composed of unbonded mineral powder, usually metal oxides, with a high melting point and a very low tendency to dissolve in water or oil. For polishing purposes, the mineral powder is reduced to a paste or is mixed with heat-resistant lubricants or paraffins to yield a polishing paste or a polishing-agent suspension.

To produce high-precision functional surfaces on workpieces, the polishing is done on a lapping machine, or, in the case of optical lens fabrication, with a polishing bowl. Such a polishing bowl is usually lined with a polishing-agent support that keeps the polishing suspension on the tool and dictates the final shape of the workpiece surface. Plastic sheeting, felt, pitch or felt flake pitch are used as polishing-agent supports.

For decorative fine-machining of surfaces, the usual approach is to use hand-operated machines with polishing tools that do not have a contour specific to the workpiece and are not intended to shape it. Instead, polishing usually serves in these cases to finish the surface for decorative purposes or to restore it in the repair shop (e.g. refinishing of varnished parts, polishing out of scratches).

Aside from exclusively manual polishing, polishing with hand-guided machines is the most widespread application for producing decorative surfaces or for finishing. A number of polishing tools for this purpose are known, and are designed to be used on machines similar to grinding stands or to be driven by means of hand drills, right-angle grinders or straight grinders.

Known, for example, from the 1998/1999 tool catalogue of the company Hch. Perschmann GmbH, Braunschweig, pp. 462 and 464, are polishing tools in which a one-piece, compact felt body, characterized as particularly long-lasting and offered in a cylindrical, conically tapered or disk-shaped embodiment with a steel shaft 6 mm in diameter, is designed to be gripped in a machine. A suitable grinding paste is also offered for use with these felt polishing bodies.

Known from the catalogue *Machinery and Tools for Surface Machining* from the firm Suhner Abrasive Expert AG, Brugg, Switzerland, 1998 edition, are solid felt polishing wheels (model designations FPS 30 to FPS 200), which can be used with machines together with holding arbors for attaching the felt polishing wheels (models FDv 6-6 et seq.). Also offered under the designations FPK0708 to FPK3035 is a series of contoured felt polishing bodies that range from small, spherical shapes for the felt through various partially conical forms to cylindrical, solid felt polishing bodies. These felt polishing bodies are also provided with shafts for mounting them in standard drill chucks.

Also known, particularly for use on vehicle bodies before and after painting, are so-called buffing wheels or buffing bells, in which the polishing body of the polishing tool consists of a packet of cotton cloths laid one on top of the other and quilted together according to the desired strength; these are arranged radially to a bore in a work-holding spindle or to the spindle itself.

The basic advantage of such buffing wheels is that there is little transfer of the contour of the tool to the workpiece, so that few marks are likely to be produced even on highly sensitive surfaces, e.g. piano lacquers.

Known from U.S. Pat. No. 3,191,208 are various buffing wheels in some of which the hardness of the wheel is further increased by folding the cotton cloth, and in which, instead of a receiving opening for a mandrel, a pronged metal pot is provided, on whose prongs, which are arranged radially about an attaching opening for connection to a mandrel of a machine, the cloth packet is threaded either with or without additional sewing up or quilting. The prongs are realized as longer than the cloth packet is thick, so that the cloth packet can be fixed in place axially by turning the ends of the prongs down once the packet has been threaded on.

Known from Patent Abstracts of Japan under JP 60094271 is a tool in which a heat-curable resin is poured over individual lengths of polishing cloth comprising a fiberglass disk so as to form an even number of packets composed of two to three plies of cloth, and the packets are arranged shingle-like on the wheel about a central receiving hole for a mandrel. This produces a tool hardness that is extremely unusually high for polishing tools, of the kind exhibited by flap wheels, so that some doubt arises as to whether a polishing tool is really being described here or whether the subject matter is a cloth with an abrasive bonded to it, in the manner of an abrasive cloth, and the tool is therefore an embodiment of the flap wheel that is known per se.

Known from DE 199 30 373 A1 is a porous polishing tool and a method for polishing a roller, designed to enable a roller to be polished to satisfactory dimensional precision and thus to prevent feed marks and streaking when the polished roller is to be used for printing.

Known from DE 198 43 267 A1 is a polishing wheel that includes a short fibrous-web layer firmly bonded to a support layer, and in which a burr-type adherent layer is disposed on the back of the polishing wheel so that it can be fastened removably to a corresponding polishing disk. Cited as an advantage is the fact that the polishing wheel can be removed from the polishing disk and washed in a household or industrial washing machine, thereby removing dried polishing agent and polishing dust. This is intended to allow the polishing wheel to be used several times.

For use with the known polishing tools described hereinabove, a suitable polishing paste must be selected that is adapted to the hardness of the felt material and its porosity, it being especially important for the admixture of lubricant or oil to be such that the polishing tool is prevented from clogging prematurely. Such premature clogging causes streaks and smears on the workpiece and can lead to burn marks in extreme cases.

This problem is reputedly avoided with the polishing wheels described in German Utility Patent DE GM 1 940 005, in which an adapted polishing agent is to be integrated in a soft bond. This is to be achieved by saturating the fabric with the polishing-agent preparation or by embedding the preparation, for example by enveloping it in lengths of cloth. It is emphasized as essential that the textile nature of such a polishing wheel is preserved, as in the case of known polishing wheels composed of flat or puffy layers of fabric.

In addition, as in the case of other polishing wheels, the machinist must maintain the proper contact pressure to achieve the desired polishing action and at the same time prevent overheating. As noted hereinabove, such overheating can lead to burn marks on the workpiece or carbonization of the polishing felt, which can in turn cause the workpiece to become scratched during subsequent use of the polishing tool.

The polishing result therefore depends on a certain degree of experience and dexterity on the part of the machinist, and on his experience in the appropriate selection of a polishing body of suitable hardness and a polishing agent adapted to the workpiece material and the polishing body.

It is therefore desired to provide a polishing tool of the type described hereinabove, having improved characteristics with regard to handling and the achievement of better working results.

SUMMARY OF THE INVENTION

The instant invention provides a polishing tool of the type described hereinabove wherein the solid polishing body is plurally subdivided.

In consequence, the polishing tool conforms especially well to the contour of the stock, thus enabling curved surfaces to be polished especially well. Such a polishing tool according to the invention, unlike buffing wheels, can also be fabricated in small dimensions, and the advantages of the invention can therefore be utilized in the polishing of smaller workpieces or the polishing of recesses and holes.

In an especially preferred embodiment, the polishing tool is characterized in that the polishing body is formed by a plurality of solid felt sheets.

In tests with this embodiment, it was found in an unforeseen manner that thermal loading of the workpiece and the polishing tool and the risk of overheating with the use of such a tool are practically nonexistent. This can be attributed to the fact that when a sheet is placed on the workpiece, the outer end of the sheet is shifted in the direction of the next sheet and on being removed from contact with the workpiece moves back into its initial position, thus creating a gap between that sheet and the next one. In this way, the polishing tool is constantly being ventilated as if by a fan and is thereby cooled. In addition, some of the cool air is carried between the sheets to the point of contact with the workpiece.

Moreover, the polishing agent can be distributed better on the surface of the polishing tool, and the risk of clogging of the felt and thus of smears being produced on the workpiece, or of the polishing tool operating on the workpiece dry, is prevented more effectively.

Finally, both concavely and convexly curved surfaces can be machined especially well with such a polishing tool according to the invention.

Particularly advantageous characteristics of a polishing tool according to the invention in terms of sufficient work output and service life are obtained if the felt sheets are about 1 mm to about 20 mm thick and/or when the felt has a pure wool (animal hair) content of at least about 30% and preferably a hardness of 0.14 to 0.68 (W4 to H5) per DIN 61200. Under these conditions, in particular, much less polishing residue falls onto the workpiece than with other polishing materials.

In certain areas of application and for use on stationary machines to perform series machining, it can be advantageous if the felt sheets are made of felt of different densities. In this way, the tool has sufficient strength while at the same time areas composed of very-low-density felt can absorb larger amounts of polishing agent.

If higher strength is desired for the polishing tool for certain applications, it can be advantageous if one or more flexible intermediate layers are provided between at least some of the felt sheets.

An especially good polishing result can be achieved with sharply contoured workpieces when at least some of the felt sheets are each subdivided transversely to their longitudinal extent, preferably at spatial intervals of about 3 mm to about 10 mm, thus giving the tool particularly high flexibility.

For good work output, it is generally advantageous if the felt sheets are permanently connected to a supporting body on at least one side and in the region of that side are juxtaposed with no gaps between them.

With especially heat-sensitive workpieces, however, it can also be advantageous if the felt sheets are permanently connected to a supporting body on at least one side and in the region of that side are juxtaposed with spacing between them.

If high strength is desired for the polishing tool despite the use of a relatively low-density felt, it can be advantageous if at least some of the felt sheets are combined into groups, with or without intermediate layers, and are connected to one another within the groups to form packets of felt sheets.

For the efficient machining of largely planar surfaces with a right-angle grinder, it is advantageous if the supporting body is a wheel and the wheel is fashioned from a synthetic-resin-bonded fiberglass disk or is made substantially of a synthetic material, preferably a fiber-reinforced synthetic material, aluminum, a hard paper (fiber material), or steel, especially if the felt sheets are arranged along the circumference of the wheel, preferably extending radially past said circumference, on the axial end face of the wheel.

In addition, inner edge areas can also be polished especially well with an embodiment of this kind.

Particularly for stationary use, in which the workpiece is, for example, guided by hand against a polishing tool, it is advantageous if the felt sheets are attached to a supporting body in a substantially approximately radial arrangement.

For connection to a prime mover via a conventional mandrel, it is advantageous if the supporting body comprises at least one hole designed to receive a mandrel to effect connection to a prime mover.

With the use of larger polishing tools preferably on stationary machines, it is advantageous for secure seating and the transmission of relatively high drive powers if the supporting body comprises at least one hole to receive a drive shaft and preferably axially along the hole a groove for a cam.

For use on conventional boring machines, flexible shafts or straight grinders, it is advantageous if a shaft connected in a rotationally fixed manner to the supporting body is provided in order to connect the polishing tool to a prime mover; this is especially inexpensive to manufacture if the supporting body is a synthetic-resin body in which the felt sheets and the shaft are embedded directly. An especially simple approach in terms of production engineering is to fabricate the supporting body by at least partially filling with synthetic material or synthetic resin a space formed between the felt sheets, positioned relative to one another, and the shaft.

For use on other machines, and especially where a quick-change attachment is needed, for example in series machining, it can be convenient if the supporting body or the shaft includes a single or multiple male or female thread, said thread preferably being a coarse, rectangular or trapezoidal thread.

The advantages of the invention, especially with respect to conservative treatment of the workpiece, can be realized particularly well if the felt sheets are arranged substantially upright on a supporting body.

BRIEF DESCRIPTION OF THE DRAWINGS

The invention will be described in more detail herein below with reference to the exemplary embodiments depicted in the drawings, which show.

DETAILED DESCRIPTION OF PREFERRED EMBODIMENTS OF THE INVENTION

Figure 1:
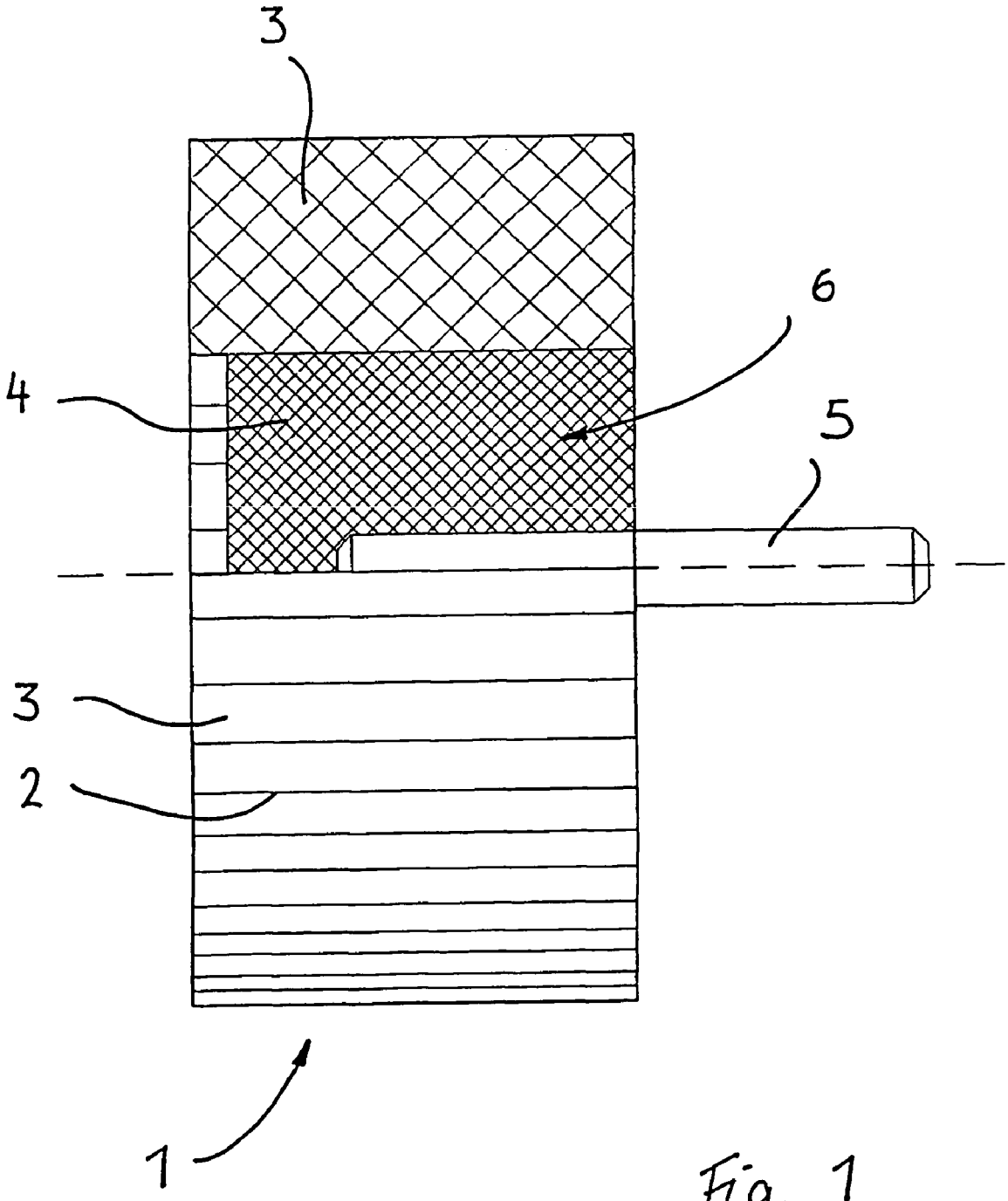
FIG. 1 shows a polishing tool according to the invention in a side view in partial section.

The polishing tool according to the invention depicted in FIG. 1 comprises a solid (not hollow) polishing body 1 made substantially of felt, which is subdivided plurally by means of slits 2, each slit 2 being formed between a plurality of solid (not hollow) felt sheets 3. The terms "solid polishing body" 1 and "solid felt sheet" 3 are to be understood here as meaning that no larger cavities or holes over and above the normal porosity of the felt used are present.

Figure 2:
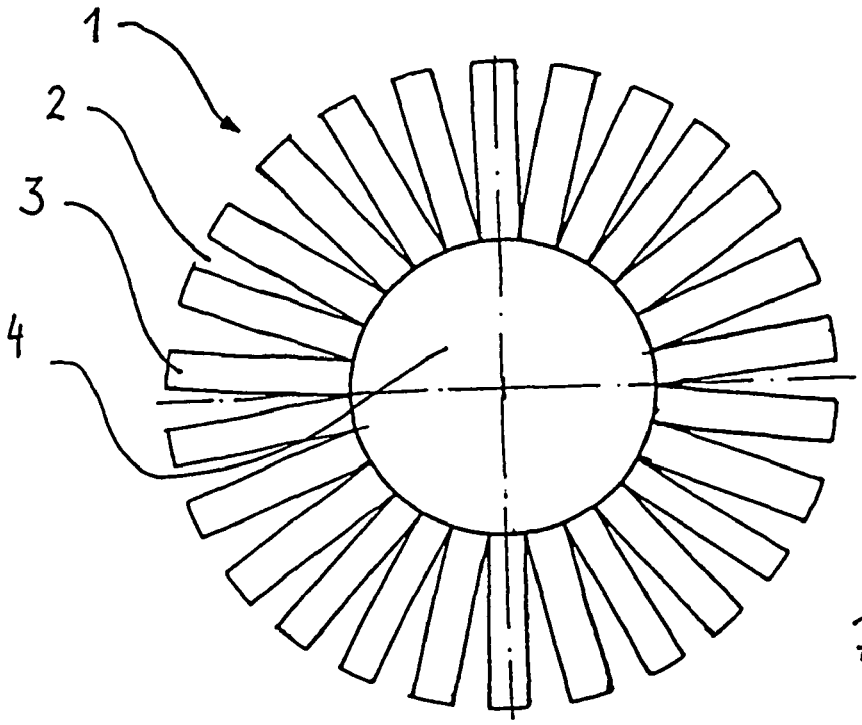
FIG. 2 shows a polishing tool according to the invention, as in FIG. 1, in a front view.
Figure 3:
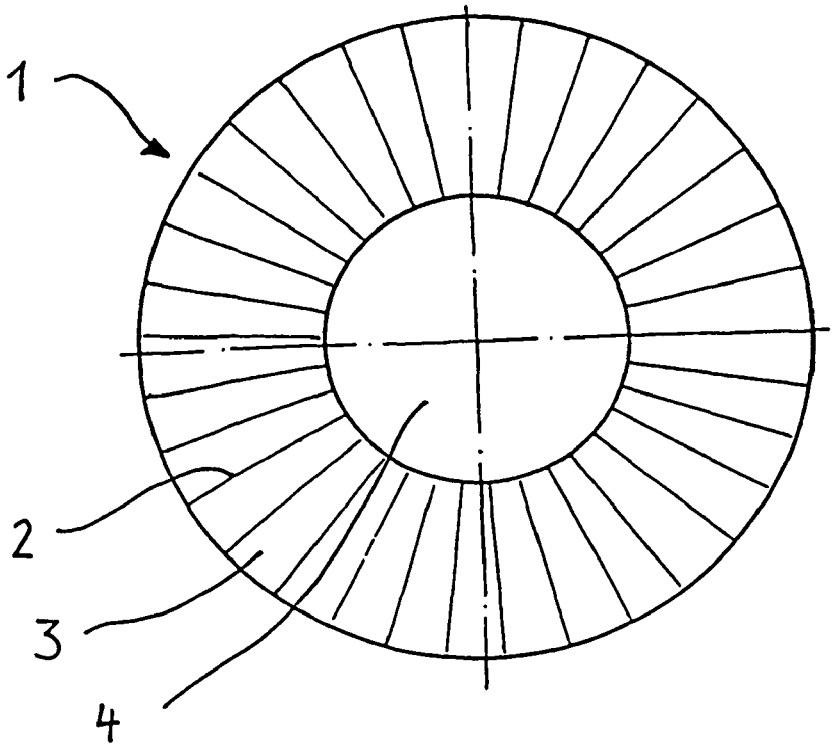
FIG. 3 shows a further embodiment of the polishing tool according to the invention as in FIG. 1 but with narrow spaces between the felt sheets, in a front view.

As can readily be seen in FIGS. 2 and 3, the felt sheets 3 are fastened to a supporting body 4 in a substantially approximately radial arrangement, preferably oriented so as to be substantially radially upright.

Provided for purposes of rotary driving by a machine tool, for example to connect the polishing tool to a standard chuck of a prime mover, is a shaft 5 connected in a rotationally fixed manner to supporting body 4. Shaft 5 advantageously has one of the standard diameters of 6 mm, 8 mm or 12 mm, depending on the size of the polishing tool and the prime mover.

Figure 4:
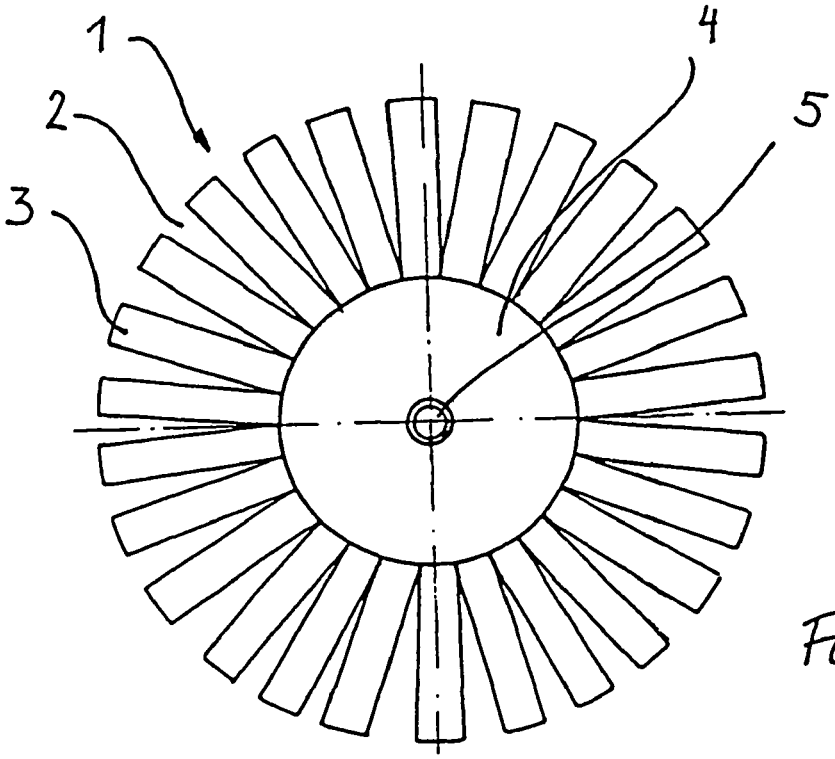
FIG. 4 shows the polishing tool according to the invention as in FIG. 2, in a back view of the drive side.
Figure 5:
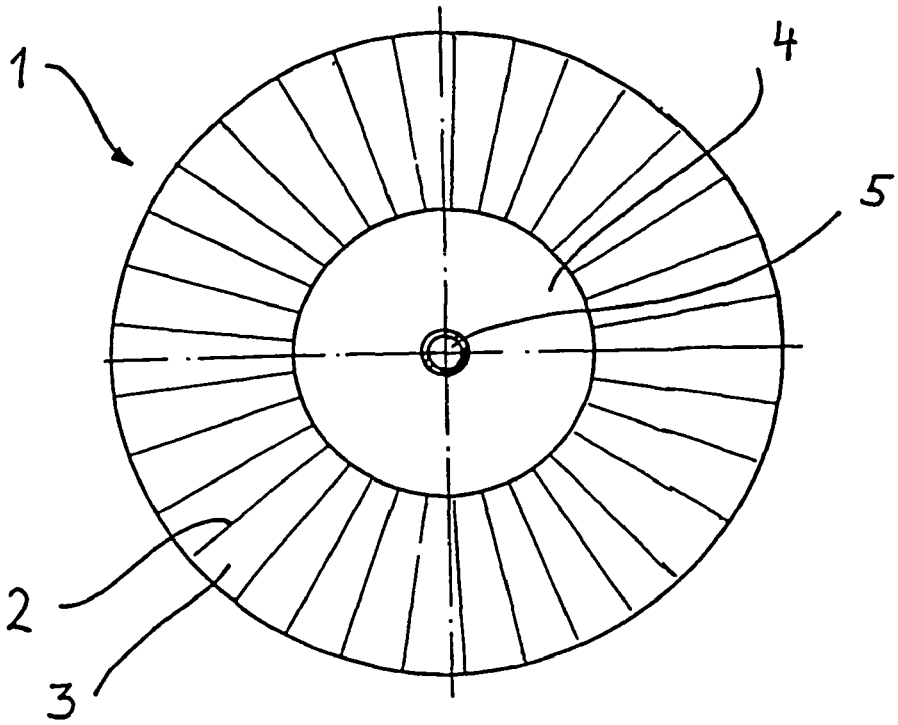
FIG. 5 shows the further polishing tool according to the invention as in FIG. 3, in a back view of the drive side.

As can readily be seen in FIG. 1 and particularly in FIGS. 4 and 5, which are views of the drive side of the polishing tool, the supporting body 4 can be a synthetic-resin body in which the felt sheets 3 and the shaft 5 are directly embedded, and which is preferably formed by at least partially filling with a synthetic material or a synthetic resin a space 6 formed between felt sheets 3, positioned relative to one another, and shaft 5.

In the embodiment of the invention illustrated in FIG. 1, polishing body 1 can have an outer diameter of more than 100 mm and a length in the axial direction of 150 mm, or it can just as readily have a diameter of only 30 mm and, for example, a length of 10 mm, depending on the purpose for which it is to be used. Correspondingly, it has been found advantageous to assign the sheets 3 a thickness of about 1 mm to about 20 mm, preferably within the range of about 3 mm to about 20 mm.

In most applications, it will be advantageous juxtapose the felt sheets 3 without gaps between them on the at least one side on which they are permanently connected to supporting body 4.

For certain applications, however, the felt sheets 3 can instead be juxtaposed with spacing between them on the side on which they are connected to supporting body 3.

If felt sheets 3 of rectangular cross section are mounted on supporting body 4, as shown in FIGS. 2 and 4, the slits 2 or gaps at the radially outward end become relatively large, thus yielding a relatively soft polishing body 1 with especially effective cooling.

If the felt sheets 3 are pressed together in the radially inner region, as shown in FIGS. 3 and 5, the slits 2 or gaps are relatively narrow at the radially outer end and a relatively firm polishing body 1 is produced.

Particularly for the efficient machining of largely planar surfaces with a right-angle grinder, a further embodiment of the polishing tool according to the invention is realized such that the supporting body is a wheel 7. The wheel 7 can advantageously be fabricated as a resin-bonded fiberglass disk or can be made from a synthetic material, preferably a fiber-reinforced synthetic material, aluminum, a hard paper (fiber material), or steel. A polishing tool of this kind is depicted in FIGS. 6, 7 and 8.

Wheel 7 comprises, for example, a hole 8 designed to receive a standard mandrel to effect the connection to a prime motor. In the case of production from a fiber-reinforced synthetic, the edge of the hole 8 is advantageously reinforced with a metal lug 9 to guarantee a secure, centered fit.

Figure 6:
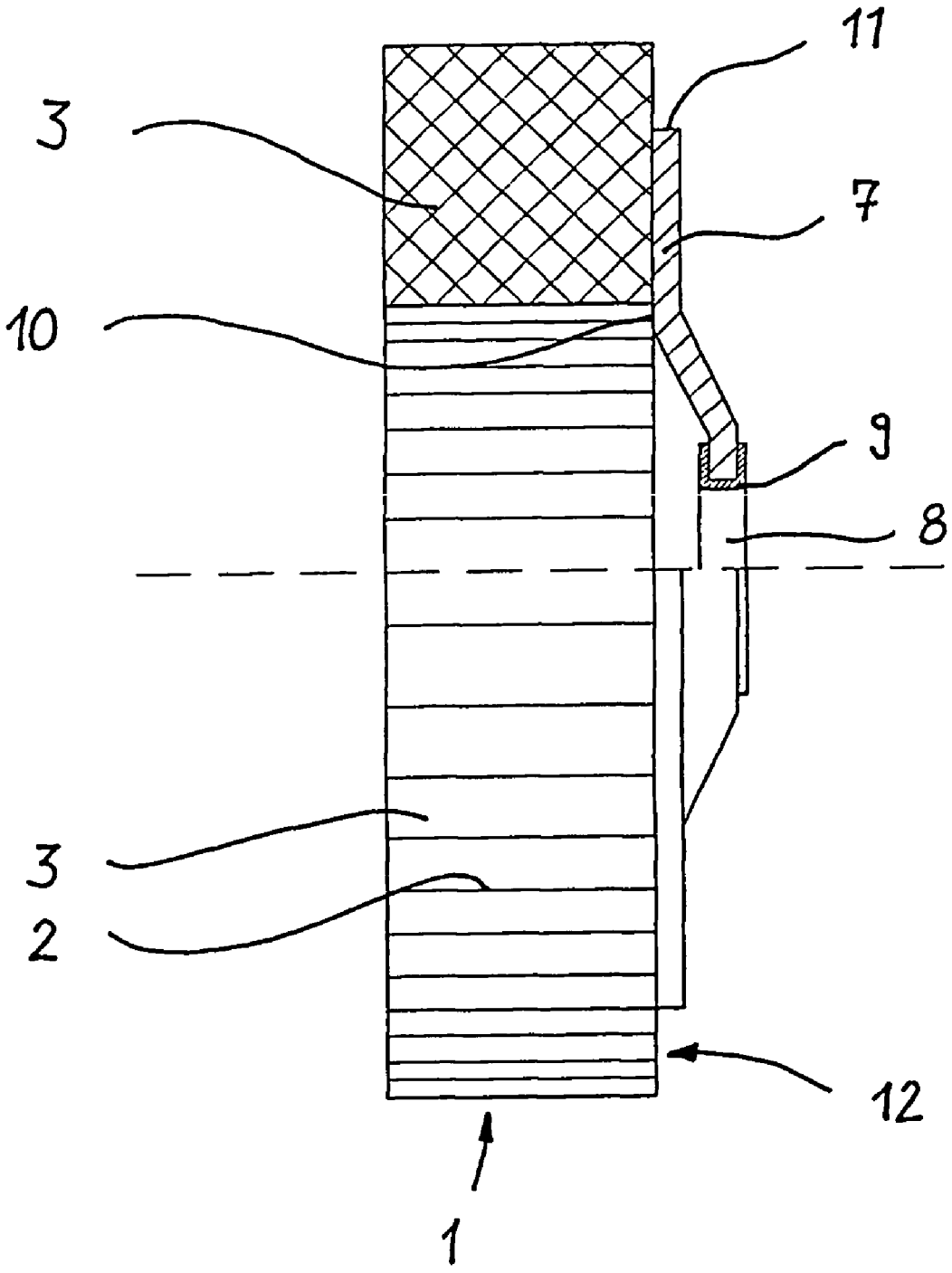
FIG. 6 shows a further embodiment polishing tool according to the invention in side view in partial section.
Figure 7:
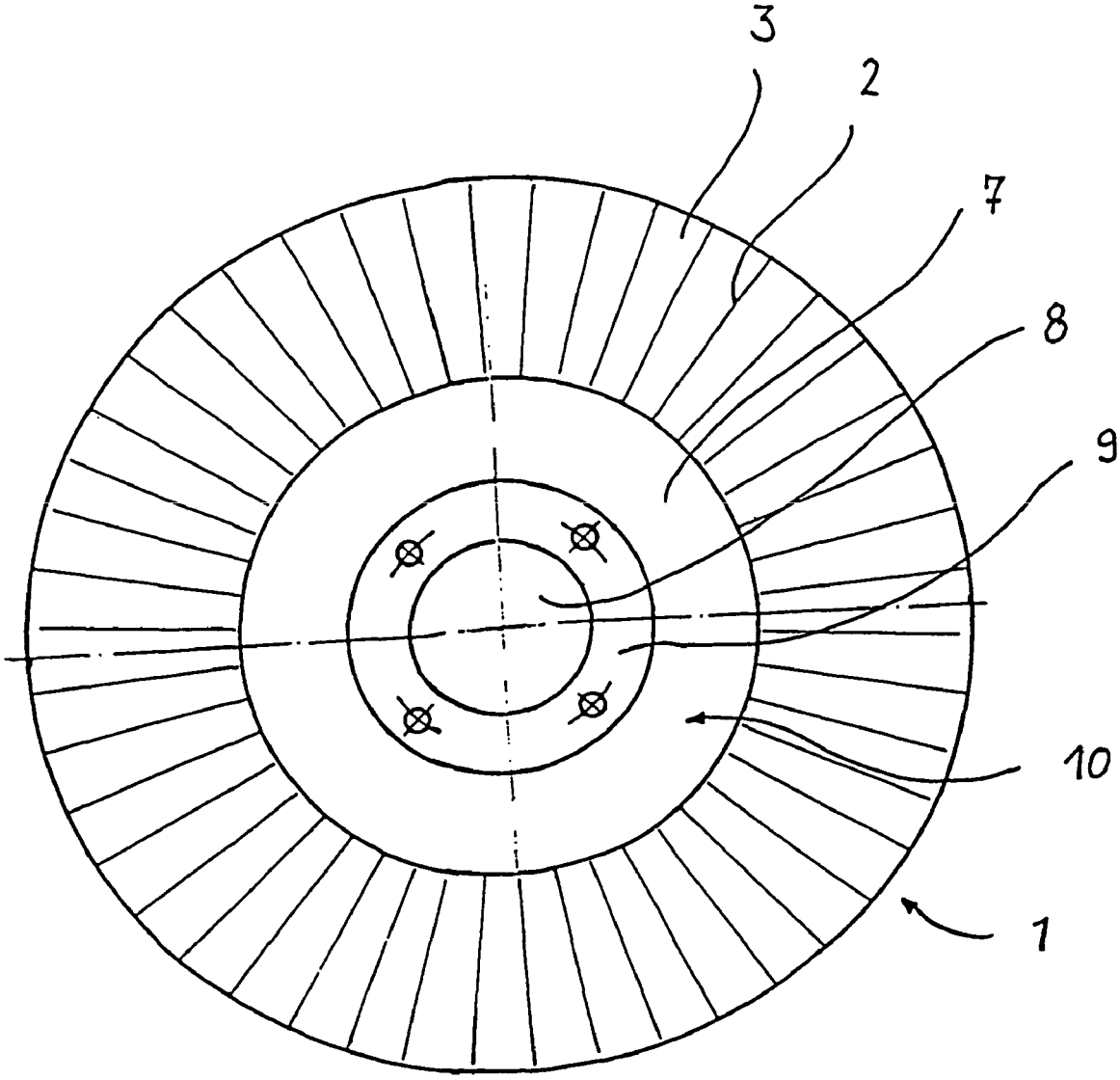
FIG. 7 shows the polishing tool according to the invention as in FIG. 6, in a front view.
Figure 8:
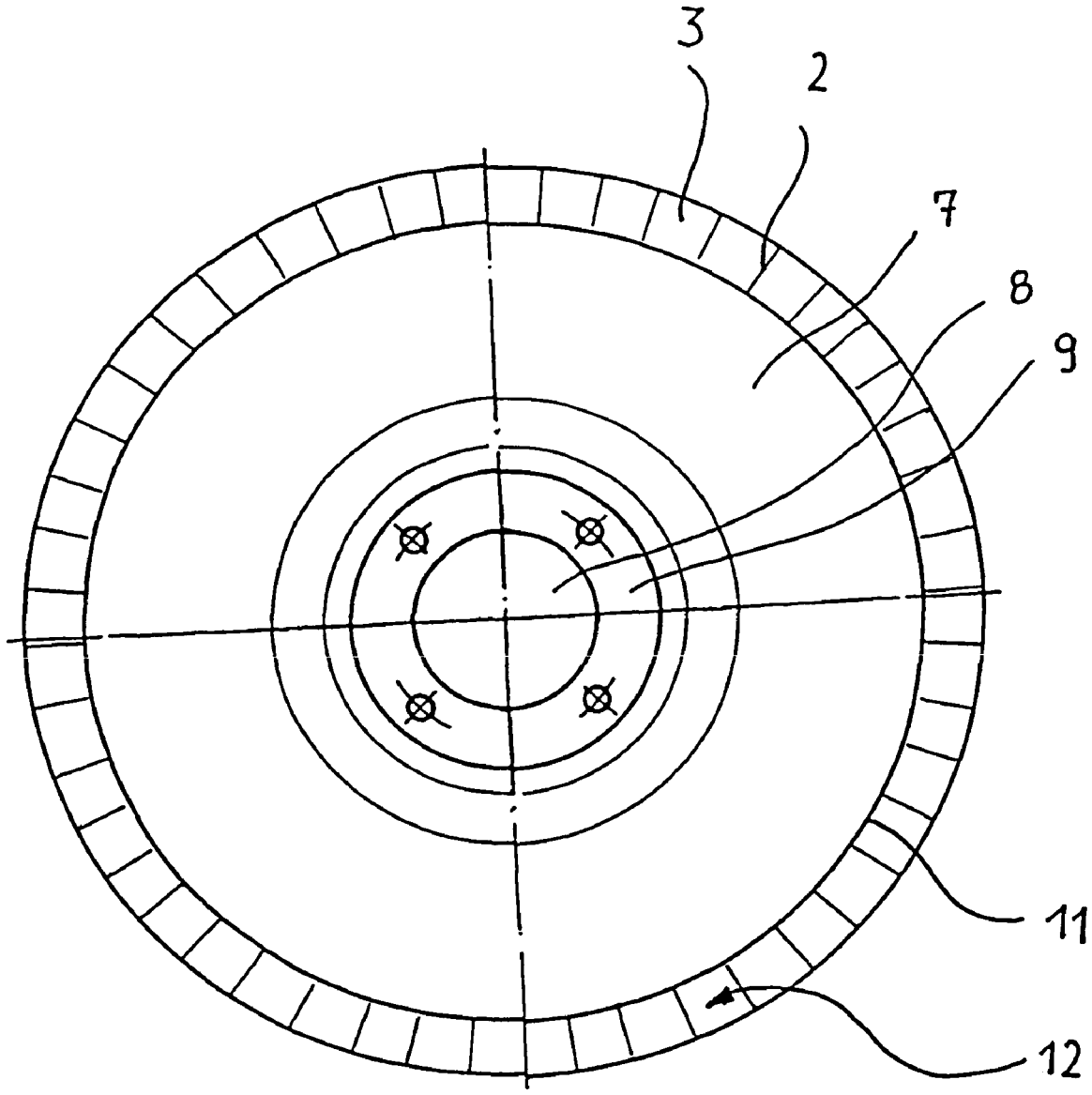
FIG. 8 shows the polishing tool according to the invention as in FIG. 6, in a back view of the drive side.

The felt sheets 3 are arranged along the circumference on the axial front side 10 of wheel 7, as can readily be seen in FIGS. 7 and 6. The sheets 7 are arranged so as to extend radially outward past the edge 11 of wheel 7 by a piece 12. This is clearly evident in FIG. 8, which is a view of the polishing tool seen from the machine side.

This enables inner edge areas also to be polished especially well with an embodiment of this kind, since this polishing tool reaches into corners.

Figure 9:
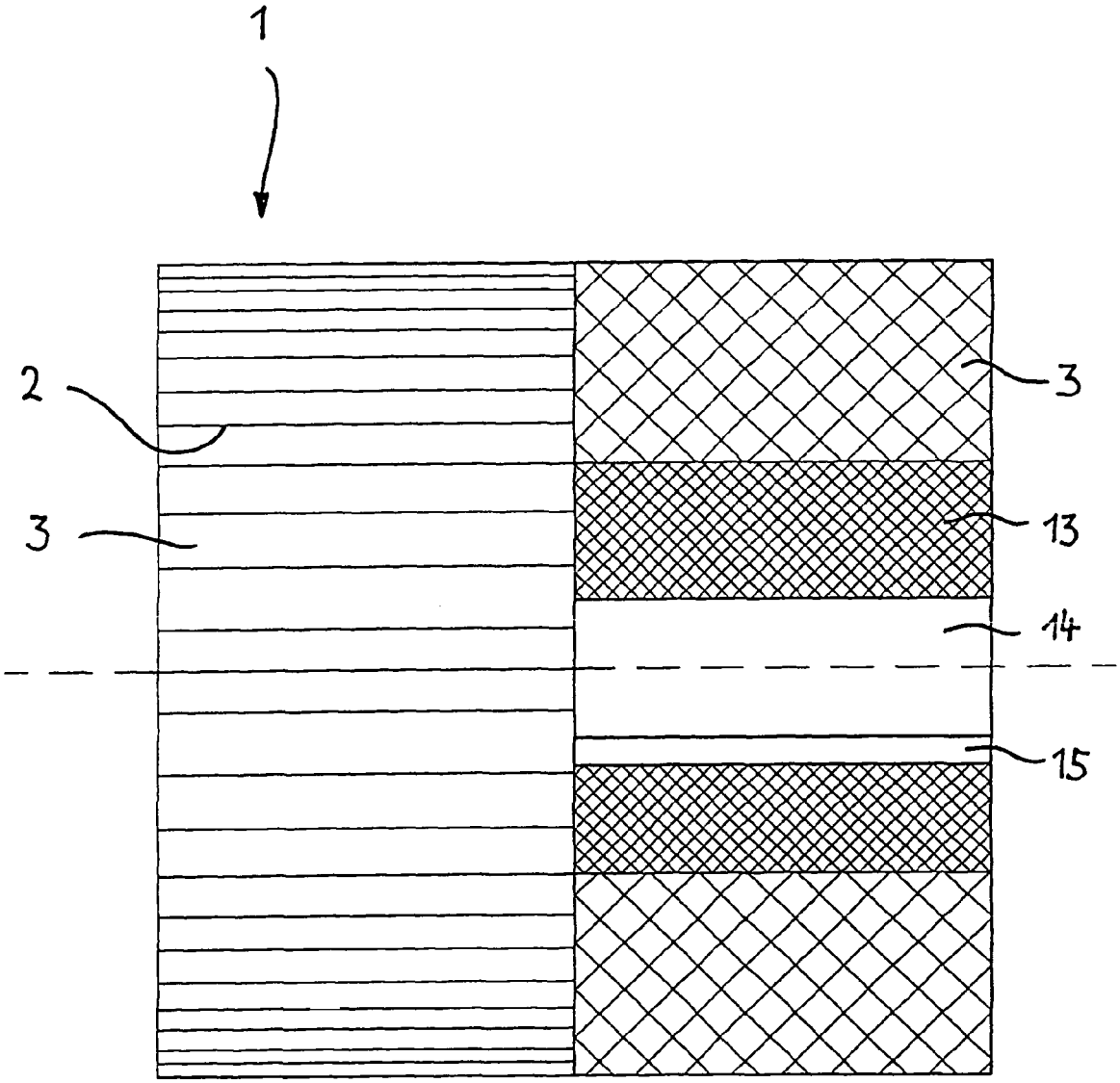
FIG. 9 shows a further embodiment polishing tool according to the invention in a side view in partial section.

Especially suitable for use on stationary machines is a polishing tool according to the invention having a cylindrical shape, as illustrated in FIG. 9. This tool is distinguished from the first-described embodiment primarily by the fact that the sheets 3 are fastened to a core 13 in which a through-hole 14 for receiving a drive shaft of the machine tool is formed, either directly or by means of a bushing (not shown).

Figure 10:
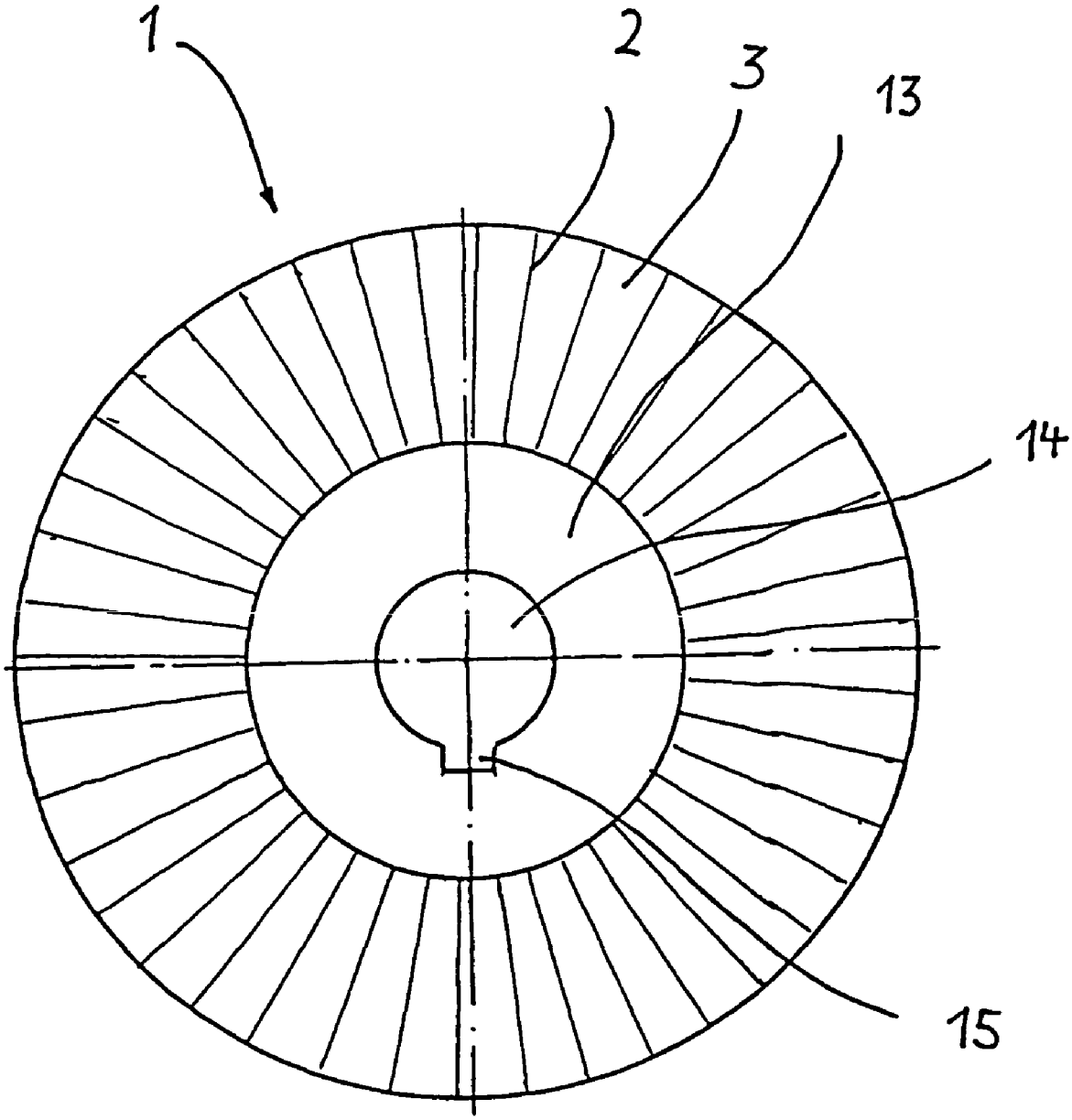
FIG. 10 shows the further polishing tool according to the invention as in FIG. 9, in a view of the front face.

This embodiment can be manufactured in an economically reasonable manner in sizes ranging to at least an outer diameter of 120 mm and correspondingly large widths. For transmitting an adapted drive power, it is then advantageous to provide, preferably axially along hole 14, a slot 15 for an entrainment means of the prime mover, e.g. a key. Such a slot 15 is clearly evident in FIG. 10. More such slots can be provided if appropriate for the power demand.

In general, such embodiments can also be provided with other drive receptacles and with an outer diameter of up to 300 mm.

In all the embodiments, it is advantageous for the felt to have a pure wool content of at least about 30%.

The felt sheets 3 can also be composed of felts of different densities, and one or more interlayers (not shown) can be provided between at least some of the felt sheets 3 to stiffen the tool. Such interlayers can be made of a suitable flexible material, including felt. In addition, to obtain a greater hardness for the polishing body 1, at least some of the felt sheets 3 can be combined into groups with or without interlayers and joined to one other within the groups, e.g. by sewing, to form packets of felt sheets.

Hole 8 of disk 7 or hole 14 of the cylindrical polishing tool can, depending on the prime mover, comprise an internal thread. Correspondingly, shaft 5 can be provided with a screw thread. The thread can be single or multiple, and particularly a coarse, rectangular or trapezoidal thread.

Figure 11:
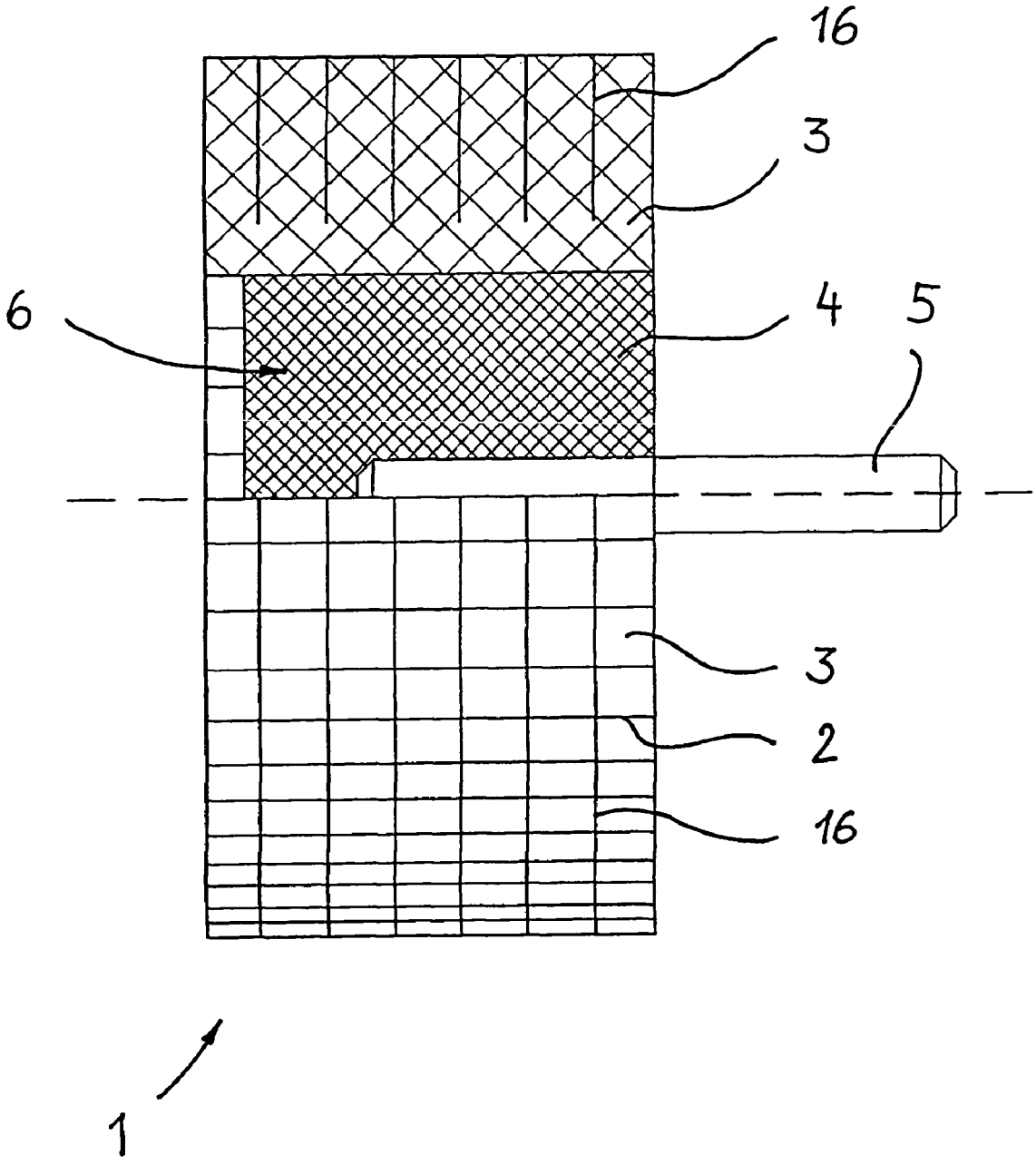
FIG. 11 shows a further embodiment of the polishing tool similar to that of FIG. 1.

An especially good polishing result can be obtained, particularly with sharply contoured workpieces, if at least some of the felt sheets 3 are each subdivided transversely to their longitudinal extent by transverse slits 16, as illustrated in FIG. 11. The transverse slits 16 can extend from the radially outer side of the felt sheets 3 through some of the depth of the felt sheets 3, or alternatively all the way to the bottom. The transverse slits 16 are preferably arranged in a spacing of about 3 mm to about 10 mm, which gives the felt sheets, in a brush-like manner, an especially high flexibility and ability to conform to the workpiece contour.

The invention claimed is:

1. A polishing tool, comprising:

a single layer synthetic resin body having a longitudinal axis;

a metal shaft directly embedded within said synthetic resin body, said shaft adapted to be rotatably driven;

a felt body comprising a plurality of radially extending felt segments having first ends directly embedded within said synthetic body and second ends projecting radially outwardly from said synthetic body with respect to the longitudinal axis, said felt segments separated by slits which extend in the direction of the longitudinal axis, said felt segments comprising felt sheets having a pure wool content of at least about 30% and a thickness in the range of 1 mm to 20 mm, said sheets having a hardness in the range of 0.14 to 0.68 (W5 to H5) per DIN 61200.

2. The polishing tool of claim 1, wherein said segments including a first plurality of segments having a first density, and a second plurality of segments having a second density different from said first density.

3. The polishing tool of claim 1, wherein at least one of said felt sheets is subdivided transversely to its longitudinal extent, at spatial intervals in the range of 3 mm to 10 mm.

4. The polishing tool of claim 1, wherein said felt sheets are connected to said supporting body without open gaps between said felt sheets.

* * * * *